US006848150B1

(12) United States Patent
Kaim

(10) Patent No.: US 6,848,150 B1
(45) Date of Patent: Feb. 1, 2005

(54) DEVICE FOR SECURING PAPERS, SHEETS OF MATERIAL, CLOTH, ETC

(75) Inventor: John T. Kaim, 12 Pearl St., Camden, ME (US) 04843

(73) Assignee: John T. Kaim, Camden, ME (US)

( * ) Notice: Subject to any disclaimer, the term of this patent is extended or adjusted under 35 U.S.C. 154(b) by 0 days.

(21) Appl. No.: 10/616,217

(22) Filed: Jul. 8, 2003

(51) Int. Cl.[7] ..... B42F 1/02
(52) U.S. Cl. ..... 24/67.3
(58) Field of Search ..... 24/67 R, 67.3, 24/67.5, 67.9, 67.11, 530, 545; 281/44, 45, 48

(56) References Cited

U.S. PATENT DOCUMENTS

| | | | | |
|---|---|---|---|---|
| 911,287 | A | | 2/1909 | Berne |
| 1,221,996 | A | | 4/1917 | Kahn |
| 1,287,764 | A | | 12/1918 | Sanderson |
| 1,439,138 | A | | 12/1922 | White |
| 1,443,443 | A | | 1/1923 | Tanner |
| 1,623,034 | A | | 3/1927 | Heath et al. |
| 1,704,737 | A | | 3/1929 | Goodman et al. |
| 1,736,558 | A | * | 11/1929 | Van Buren ..... 24/67.3 |
| 1,869,032 | A | * | 7/1932 | Van Buren ..... 24/67.3 |
| 2,234,294 | A | * | 3/1941 | Van Buren ..... 24/67.3 |
| 2,553,370 | A | | 5/1951 | Huppert ..... 132/48 |
| 3,018,532 | A | | 1/1962 | Rinaldi ..... 24/153 |
| 3,167,329 | A | | 1/1965 | Ernst ..... 281/44 |
| 3,898,717 | A | | 8/1975 | Schwartz ..... 24/259 |
| 3,924,307 | A | * | 12/1975 | Tate ..... 24/543 |
| 4,991,269 | A | * | 2/1991 | Kuroda ..... 24/67.11 |

* cited by examiner

*Primary Examiner*—James R. Brittain
(74) *Attorney, Agent, or Firm*—Cooper & Dunham LLP

(57) ABSTRACT

A binding device for holding papers and other sheets of material of diverse sizes and shapes which allows the papers to be easily removed and reinserted is provided. The device includes a rigid frame with first and second lips formed on the rigid frame, a first set of teeth and a first gap formed on the second lip, and a flexible arcuate spring member. One end of the spring member is attached to the first lip. A second set of teeth and a second gap are formed at the other end of the spring member. The spring member is placed in a closed position by maneuvering the spring member to guide one of the teeth in the second set through the first gap, and to align the first and second sets of teeth.

16 Claims, 6 Drawing Sheets

FIG.1B
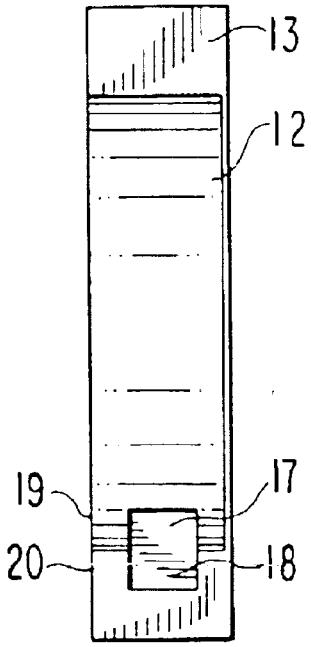
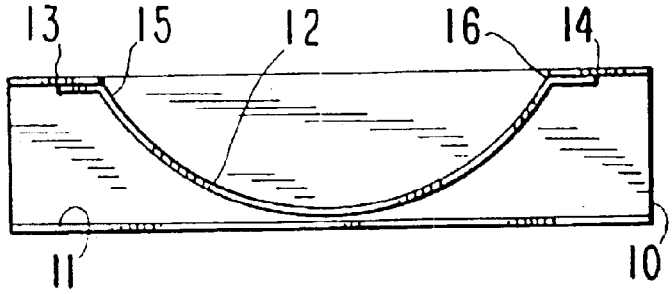
FIG.1C
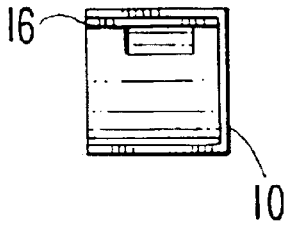
FIG.1A

DEVICE FOR SECURING PAPERS, SHEETS OF MATERIAL, CLOTH, ETC

FIELD OF THE INVENTION

The present application relates to a binding device for securing papers, sheets of material, cloth, etc. In particular, the application relates to a device for holding papers or sheets which allows the papers or sheets to be easily removed and reinserted.

BACKGROUND

Many devices have been proposed for binding sheets of paper, as a means for organizing the sheets of paper. Some conventional paper binding devices require holes punched in the sheets. The punching of holes sometimes removes relevant information. The punched holes also may render the sheets more susceptible to wear and tear.

Many paper binding devices involve complex mechanisms which are time consuming to operate and expensive to manufacture.

There remains a need for binding devices which do not require punched holes, are easy (and quick) to operate, and are cheap to manufacture.

BRIEF DESCRIPTION OF THE DRAWINGS

The present application would be more readily understood from the following detailed description by referring to the accompanying drawings wherein:

FIGS. 1A, 1B and 1C show front, top and side views, respectively, of a binding device, according to one embodiment of the present application;

DETAILED DESCRIPTION OF THE INVENTION

Figure 2:
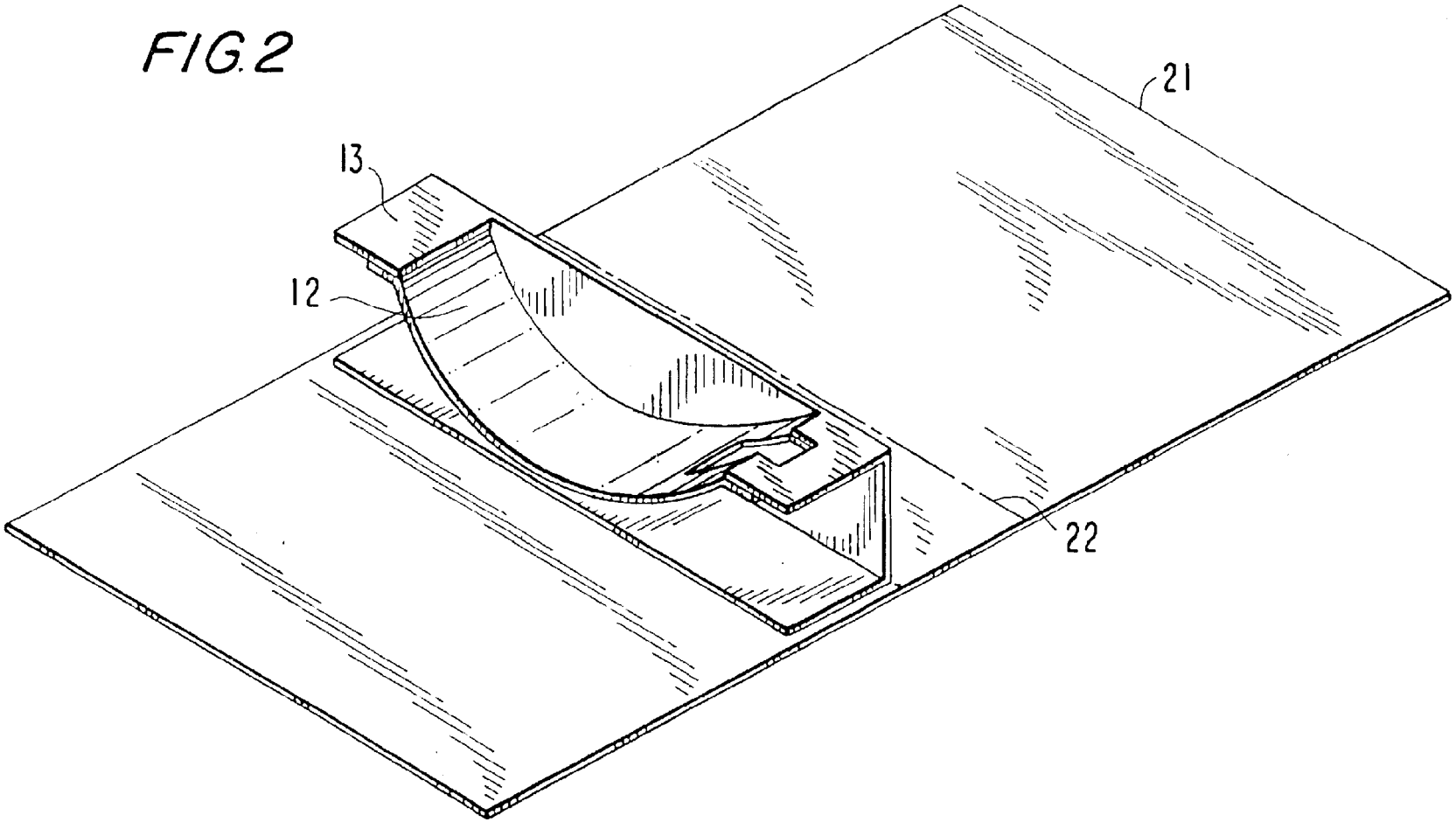
FIG. 2 shows a perspective view of a binding device, according to one embodiment.

The present disclosure describes binding devices for securing papers or sheets of diverse size and shape (such as newspaper clippings, invoices, school papers, medical or business records, etc.). The devices may also be adapted for binding together pieces of materials, cloth, etc. Binding devices according to the present application provide an apparatus for conveniently and securely holding papers or sheets of material of varying widths and thicknesses without the need to create holes in the papers or sheets of material.

To explain the invention, we describe some embodiments in connection with the figures and their supporting descriptions provided below. It should be understood, however, that the invention is not limited to the precise embodiments described below and that various changes and modifications thereof may be effected by one skilled in the art without departing from the spirit or scope of the invention. For example, elements and/or features of different illustrative embodiments may be combined with each other and/or substituted for each other within the scope of this disclosure and appended claims. In addition, improvements and modifications which become apparent to persons of ordinary skill in the art after reading this disclosure, the drawings and the appended claims are deemed within the spirit and scope of the present invention.

First Embodiment

Referring to FIGS. 1A–1C, a binding device 1 for securing papers or sheets of material, according to a first exemplary embodiment, includes a rigid frame 10, a first lip 13 and a second lip 14 formed on the rigid frame, and a flexible arcuate spring member 12 attached to the first lip such that papers or sheets of material are held against a base surface 11 of the rigid frame.

The operation of the binding device 1 includes coupling of a second set of teeth 19 formed at an end of the flexible arcuate spring member 12 with a matching first set of teeth 20 in the second lip 14. In addition, gaps 17 and 18 are provided in the respective sets of teeth through which the opposing set of teeth can be guided. It should be noted that the gap 18 is wider than the width of each of the teeth 19, and the gap 17 is wider than the width of each of the teeth 20, in order to allow one of the teeth 19 to be maneuvered through gap 18, and one of the teeth 20 through gap 17 (discussed below).

The Rigid Frame

The first lip 13 and the second lip 14 are formed on the rigid frame 10. Formed on the second lip 14 is the set of teeth 20. The set of teeth 20 includes the gap 18 formed therebetween. As shown in FIG. 1B, there are two teeth in the set. One skilled in the art should appreciate, however, that there may be two or more teeth in each set.

The rigid frame 10 may be constructed from one or more of a variety of suitable materials selected based upon material strength, manufacturability, cost, and other considerations.

The base surface 11 of the rigid frame 10 can be securely attached to a cover element 21 (FIG. 2), using any suitable conventional fasteners or fastener means.

The cover element 21 may be a rectangular sheet of rigid or semi-rigid material. The cover element 21 can include a plurality of folds 22 and preferably is dimensioned so as to envelop and form a protective cover around the papers or sheet material held within the binding device.

Alternative embodiments may include varied attachment orientations of the rigid frame 10 relative to the cover element 21 to accommodate paper or sheets of material of a variety of dimensions or layouts. The cover element 21 may also be dimensioned so as to be larger or smaller than a length of the rigid frame 10 along the long axis of the rigid frame. Further, the cover element 21 may be formed of only a single sheet of unfolded material (not shown), such that the cover element 21 does not envelop and form a protective cover over the papers or sheet material held by the binding device, yet allows for convenient handling of the binding device.

Alternative embodiments may also include planar or nonplanar rigid frame base surfaces of dimensions allowing for different mounting orientations of the rigid frame to the cover element, or to other surfaces. The base surface of the rigid frame may be elongated or shortened to allow more efficient securing of the rigid frame to the cover element. Further, holes or shapes of other geometry may be formed in the base surface to allow the rigid frame to be attached to other planar or nonplanar surfaces.

The Flexible Arcuate Spring Member

The dimensions of the flexible arcuate spring member 12 will typically depend on the dimensions of the rigid frame 10, and in particular a length of the spring member depends on a length of the rigid frame 10 (that is, the frame length, measured along the long axis of the frame, will typically be the controlling dimension). The spring member 12 is dimensioned such that the spring member 12 spans a distance between the first lip 13 and the second lip 14. The spring member 12 may be constructed from any suitable material or materials having spring properties.

Referring to FIGS. 1A–1C, a first end 15 of the spring member 12 of the first embodiment is attached to the first lip 13 of the frame 10 through the use of conventional fasteners or other fastening means. Formed upon an opposing end 16 (hereinafter "free end") of the spring member 12 is the set of teeth 19 with the gap 17 formed therebetween.

Due to arcuate profile and spring properties of the spring member 12, the overall length of the spring member increases as the spring member is flattened through the application of force. The spring member 12, the gap 17, the gap 18, the set of teeth 19, and the set of teeth 20 are dimensioned to allow for expansion of the overall length of the spring member when it is compressed to bind a large thickness of paper or sheet material being held in the binding device.

Figure 4B:
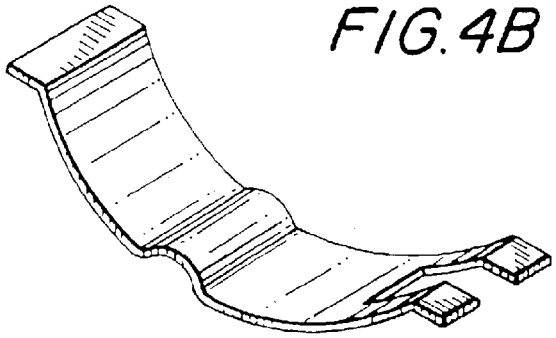
FIGS. 4A and 4B show perspective views of flexible arcuate spring members, according to one embodiment.
Figure 4A:
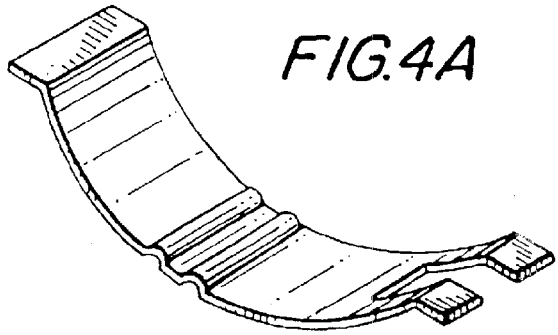

In alternative embodiments, the flexible arcuate spring member may be formed with one or more relief indentations in the arcuate portion of the spring member, as shown in FIGS. 4A and 4B. The relief indentations may allow for the convenient holding of one or more writing instruments in conjunction with the papers or sheet materials held by the binding device.

Operation

In operation, the binding device is placed in a closed position by maneuvering the free end 16 of the spring member 12 above the second lip 14, such that one of the first set of teeth 19 is aligned with the second gap 18 formed in the second lip. A force is applied to the spring member 12 to guide the aligned tooth 19 through the second gap 18 and to bring the spring member 12 into contact with the base surface 11 of the rigid frame 10. The spring member 12 is compressed as the tooth 19 is guided through and below the second gap 18. The spring member 12 is then moved in a direction perpendicular to the long axis of the rigid frame to align the first set of teeth 19 with the second set of teeth 20 formed in the second lip 14.

The spring compressing force is then removed, allowing the spring force of the spring member 12 to secure the free end 16 against the second lip formed upon the rigid frame.

In the closed position, the spring force of the compressed spring member 12 therefore acts upon the first lip 13, the second lip 14, and the base surface 11. Paper or sheet material positioned on the base surface 11 and under the spring member 12 is thus held against the base surface by the compressive force of the spring member.

The binding device is opened by reversing the closing operation.

Second Embodiment

Figure 3:
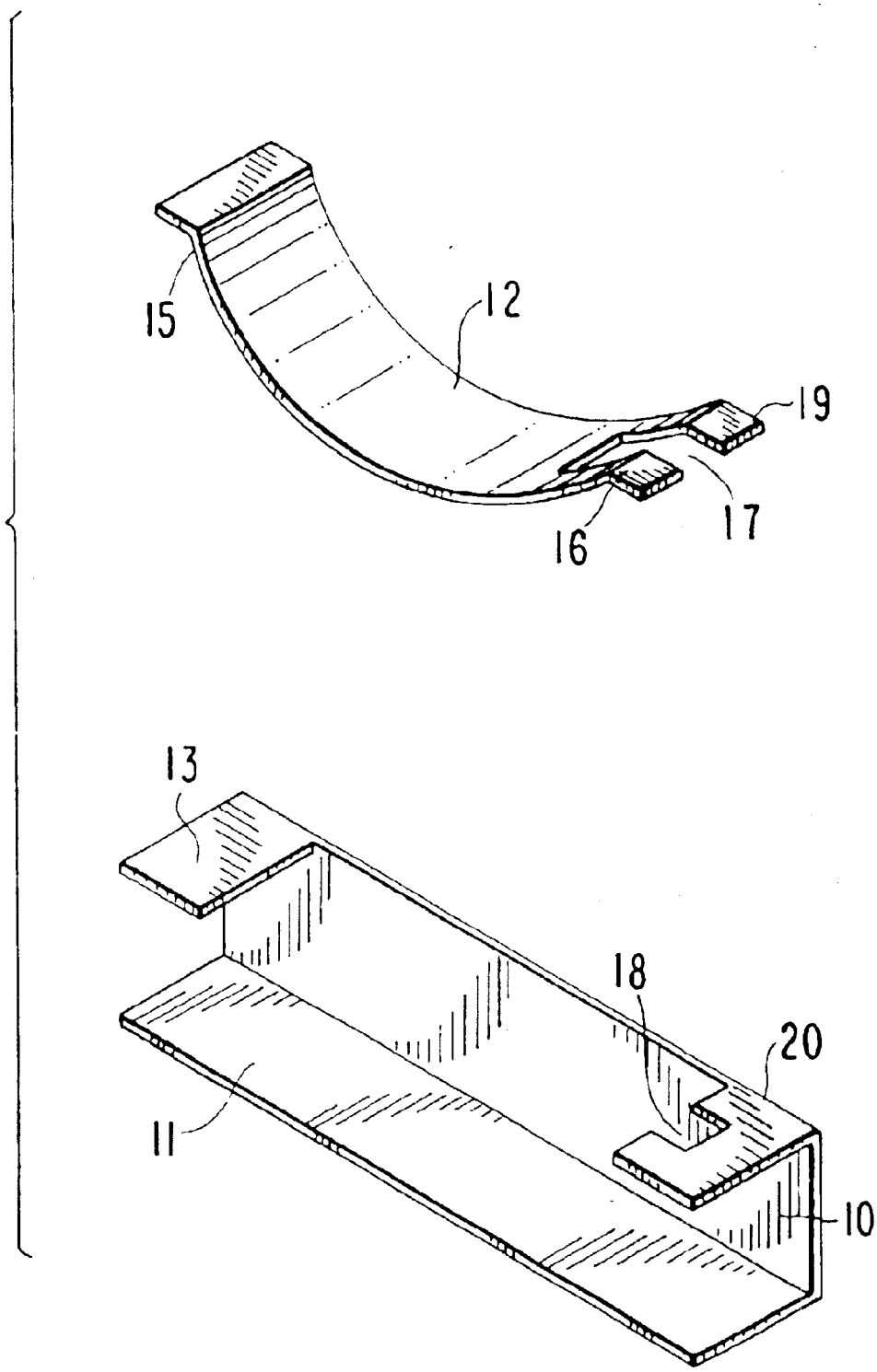
FIG. 3 shows an perspective exploded assembly view of a binding device, according to one embodiment.
Figure 5:
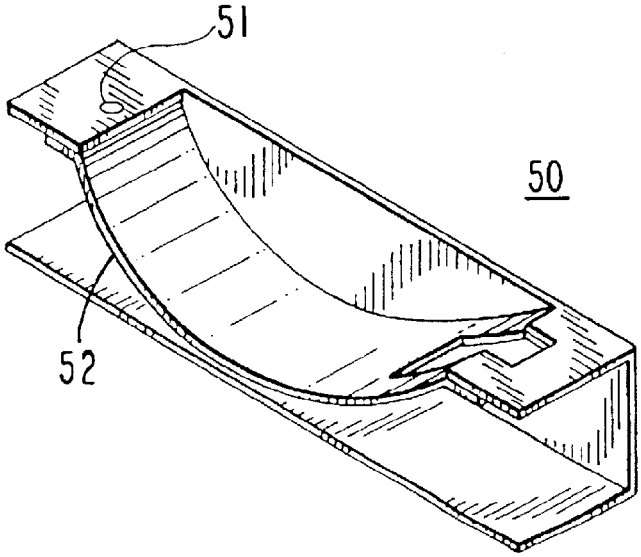
FIG. 5 shows a perspective view of a binding device including a rotatably attached flexible arcuate spring member, according to a second embodiment.

A second embodiment is explained below with reference to FIG. 5. Binding device 50 includes a rigid frame, base surface, first and second lips, first and second sets of teeth, and first and second gaps, in a configuration substantially similar to that of the first embodiment described above and shown in FIGS. 1–3. Corresponding elements will be described with reference to the numbers assigned in FIGS. 1–3.

The binding device 50 also includes a flexible arcuate spring member 52 rotatably attached to the first lip 13. An end of the spring member 52 is rotatably attached about a pivoting fastener 51 having an axis substantially normal to the surface of the first lip 13. The pivot may be constructed of any suitable conventional fastener or fastening means.

The rotatable attachment of the spring member 52 can allow rotation of the spring member about an axis substantially perpendicular to the base surface 11, to allow a greater range of motion of the spring member 52 and to allow for greater ease of use of the binding device.

The rotatable attachment may be constructed such that the spring member 52 can be temporarily detached from, and conveniently reattached to, the rigid frame 10, allowing for greater ease of use and portability of the device.

The rotatable attachment of the spring member 52 may also allow for greater ease of use of the binding device due to a reduction in a quantity of force required to perform the closing and opening operations as described above.

Third Embodiment

Figure 6A:
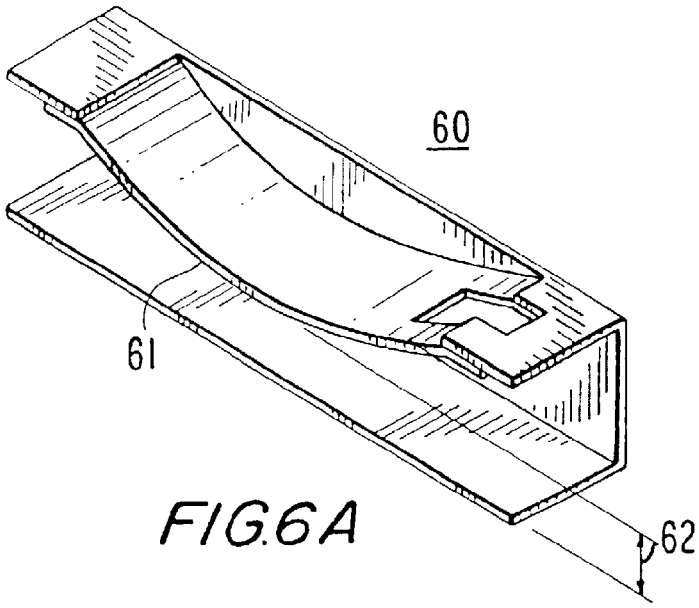
FIGS. 6A and 6B show a perspective view of a binding device configured to hold apparel and other similar materials and a front view of a spacer block, respectively, according to a third embodiment.

According to a third embodiment (FIG. 6), binding device 60 includes a rigid frame, base surface, first and second lips, first and second sets of teeth, and first and second gaps, in a configuration substantially similar to that of the first embodiment described above. Corresponding elements will be described with reference to the numbers assigned in FIGS. 1–3.

The binding device 60 also includes a flexible arcuate spring member 61 attached to the first lip 13. The spring member 61 may be constructed so as to contact the base surface when the spring member is in the closed position, or to form a gap 62 between a surface of the spring member and the base surface when the spring member is in a closed position. The binding device of the third embodiment may be used for holding or binding a variety of apparel items or other objects having similar geometry, and the gap 62 may be modified by varying dimensions of the spring member 61.

Figure 6B:
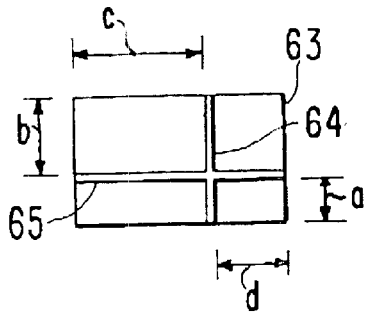

Additionally, at least one adjustable spacer block 63 may be utilized to modify and enhance the binding action of the device, by acting as extensions of the binding surface of the spring member. Referring to FIG. 6B, the spacer block 63 may include offset mounting grooves 64, 65 for mounting of the block to the spring member. As the spring member is put in the closed position, the spacer block 63 can be used to adjust the gap 62 between the surface of the spring member and the base surface 11 of the rigid frame, to accommodate materials of different thicknesses.

The offset grooves 64, 65 allow adjustment of the gap 62 by selection of the orientation of the block relative to the base surface. Referring to FIG. 6B, two offset grooves 64, 65 may provide four different dimensions, a, b, c, and d, allowing at least four adjustments to be made to the binding effect of the spring member, depending upon the orientation of the spacer block 63 to the spring member 61. A larger number of available adjustment dimensions may be possible by the creation of additional offset grooves in the spacer block 63.

Fourth Embodiment

Figure 7:
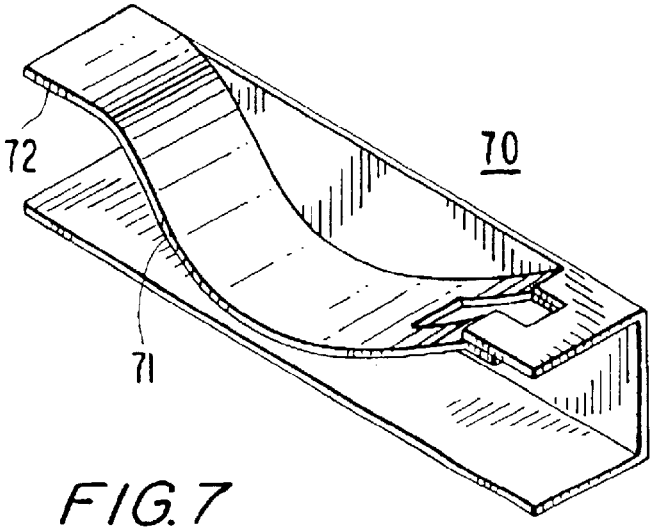
FIG. 7 shows a binding device having an integrated flexible arcuate spring member and rigid frame, according to a fourth embodiment.

A fourth embodiment is explained below with reference to FIG. 7. Binding device 70 includes a rigid frame, a base surface, a second lip, first and second sets of teeth, and first and second gaps in a configuration substantially similar to that of the first embodiment described above. Corresponding elements will be described with reference to the numbers assigned in FIGS. 1–3.

The binding device 70 also includes a flexible arcuate spring member 71 formed integrally with the first lip 72.

The integrally-formed spring member and lip of the fourth embodiment allow for greater reliability and useful life of the binding device. Further, the binding device 70 may provide advantages if ease of manufacture and material selection.

Fifth Embodiment

Figure 8:
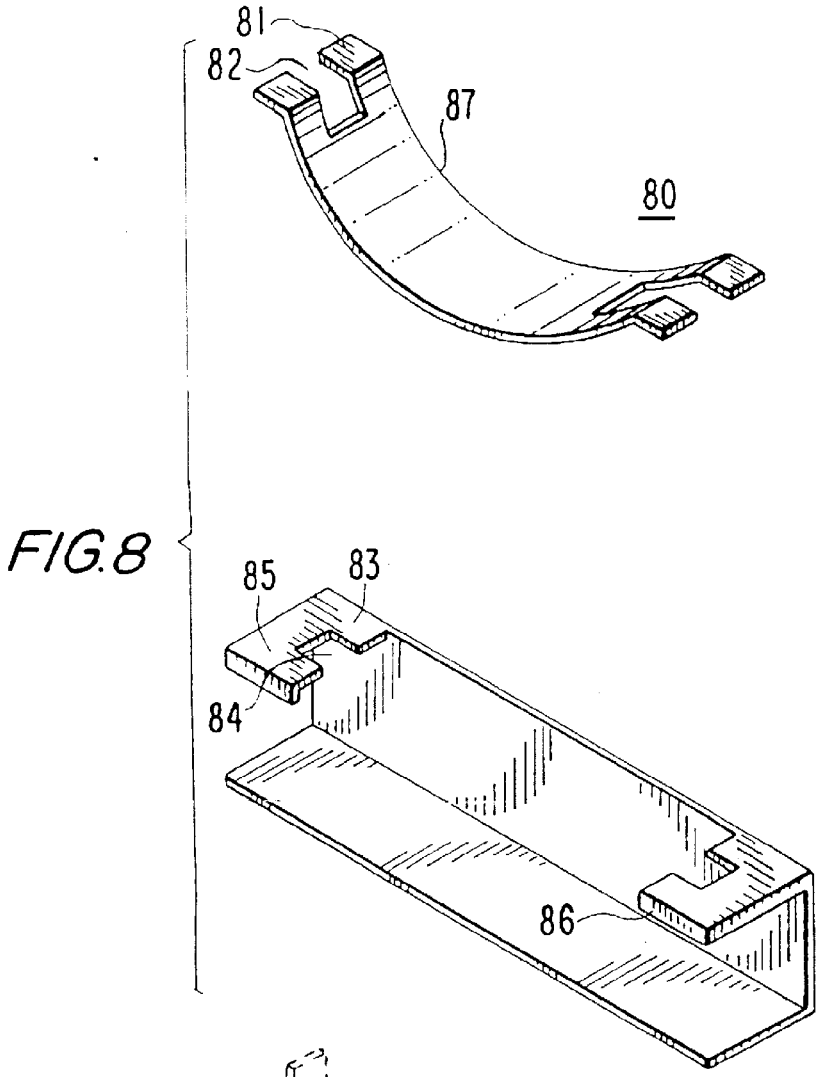
FIG. 8 shows a binding device having a detachable flexible arcuate spring member and rigid frame, according to a fifth embodiment.

According to a fifth embodiment (FIG. 8), binding device 80 includes a rigid frame, base surface, a second lip, first and second sets of teeth, and first and second gaps in a configuration substantially similar to that of the first embodiment described above. Corresponding elements will be described with reference to the numbers assigned in FIGS. 1–3.

The binding device 80 also includes a flexible arcuate spring member 87 that is unattached to either the first lip or the second lip of the rigid frame 10. The spring member 87 may be constructed and dimensioned so as to additionally include a set of teeth 81 formed at an end opposite the free end 16, and a gap 82 formed therebetween.

Correspondingly, the lip 85 of the frame of the fifth embodiment may include a fourth set of teeth 83 and a fourth gap 84 formed therebetween. Additionally, retaining ridges 86 may be formed at or near the edges of the first lip 85 and the second lip 14, for holding the spring member in place and for allowing ease of operation of the binding device. The configuration of the fifth embodiment may provide greater ease of use of the binding device by allowing the closing operation to be performed with respect to either end of the spring member 87.

Sixth Embodiment

Figure 9:
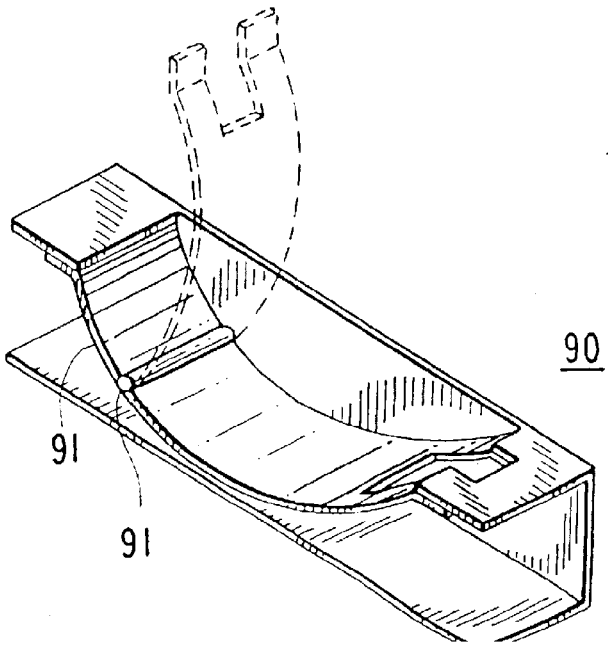
FIG. 9 shows a binding device having a flexible arcuate spring member including a hinge and a rigid frame, according to a sixth embodiment.

A sixth embodiment is explained below with reference to FIG. 9. Binding device 90 includes a rigid frame, base surface, first and second lips, first and second sets of teeth, and first and second gaps in a configuration substantially similar to that of the first embodiment described above. Corresponding elements will be described with reference to the numbers assigned in FIGS. 1–3.

The binding device 90 also includes a flexible arcuate spring member 91 attached to the first lip 13. The spring member 91 may be constructed so as to include a hinge 92 dividing the spring member. The hinge 92 may allow the spring member to be conveniently manipulated and the papers or sheets of material to be easily inserted and removed. The hinge may preferably be located near to a point of attachment of the spring member 91 to the first lip 13.

What is claimed is:

1. A device for binding paper, sheets of material, cloth, etc., comprising:

a rigid frame including a base surface;

a first lip formed on the rigid frame;

a second lip formed on the rigid frame, the second lip including a first set of teeth and a first gap in the first set of teeth;

a flexible arcuate spring member having first and second ends, the spring member including a second set of teeth formed at the second end of the spring member and a second gap formed in the second set of teeth; and at least one adjustable spacer block, wherein the first end of the spring member is attached to the first lip, and the spring member is placed in a closed position by maneuvering the spring member to guide one of the teeth in the second set through the first gap and to align the second set of teeth with the first set of teeth, respectively, wherein the at least one adjustable spacer block is positioned on the spring member, and wherein said paper, sheets of material, cloth, etc., are held between the at least one adjustable spacer block and the base surface when the spring member is in the closed position.

2. The device of claim 1, wherein the first end of the spring member is rotatably attached to the first lip, and can rotate about an axis substantially perpendicular to the base surface of the rigid frame.

3. The device of claim 1, wherein the flexible arcuate spring member is integrated with the first lip of the rigid frame.

4. The device of claim 1, wherein the flexible arcuate spring member is detachable from, and reattachable to, the rigid frame.

5. The device of claim 1, wherein the flexible arcuate spring member includes at least one recess formed thereon for holding nonplanar objects.

6. The device for binding paper, sheets of material, cloth, etc., comprising:

a rigid frame including a base surface;

a first lip formed on the rigid frame;

a second lip formed on the rigid frame, the second lip including a first set of teeth and a first gap in the first set of teeth; and a flexible arcuate spring member having first and second ends, the spring member including a second set of teeth formed at the second end of the spring member and a second gap formed in the second set of teeth, wherein the first end of the spring member is attached to the first lip, and the spring member is placed in a closed position by maneuvering the spring member to guide one of the teeth in the second set through the first gap and to align the second set of teeth with the first set of teeth, respectively, and wherein the flexible arcuate spring member includes a hinge positioned between the first end of the spring member and the second end of the spring member, and can be rotated about an axis parallel to the base surface.

7. The device of claim 1, further comprising a cover element attached to the rigid frame.

8. The device of claim 1, further comprising at least one retaining ridge formed at or near an exterior edge of the first lip or the second lip.

9. A material holding apparatus, comprising:

a rigid frame including a base surface;

a first lip formed on the rigid frame;

a second lip formed on the rigid frame, the second lip including a first set of teeth and a first gap in the first set of teeth;

a flexible arcuate spring member having first and second ends, the spring member including a second set of teeth formed at the second end and a second gap formed in the second set of teeth; and at least one adjustable spacer block, wherein the first end of the spring member is attached to the first lip, and the spring member is placed in a closed position by guiding the spring member to maneuver one of the teeth in the second set through the first gap, and to align the second set of teeth with the first set of teeth, the at least one adjustable spacer block is positioned on the spring member, and material is held between the at least one adjustable spacer block and the base surface when the spring member is in the closed position.

10. The material holding apparatus of claim 9, wherein the first end of the spring member is rotatably attached to the first lip, and can rotate about an axis substantially perpendicular to the base surface of the rigid frame.

11. The paper holding apparatus of claim 9, wherein the flexible arcuate spring member is integrated with the first lip of the rigid frame.

12. The material holding apparatus of claim 9, wherein the flexible arcuate spring member is detachable from, and reattachable to, the rigid frame.

13. The material holding apparatus of claim 9, wherein the flexible arcuate spring member includes at least one recess formed thereon for holding nonplanar objects.

14. The material holding apparatus of claim 9, wherein the flexible arcuate spring member includes a hinge positioned between the first end of the spring member and the second end of the spring member, and can be rotated about an axis parallel to the base surface.

15. The material holding apparatus of claim 9, further comprising a cover element attached to the rigid frame.

16. The material holding apparatus of claim 9, further comprising at least one retaining ridge formed at or near an exterior edge of the first lip or the second lip.

* * * * *